US010961085B2

(12) United States Patent
Lindberg et al.

(10) Patent No.: US 10,961,085 B2
(45) Date of Patent: Mar. 30, 2021

(54) LOW-CONSTRUCTION TROLLEY FOR WIRE ROPE HOIST

(71) Applicant: Konecranes Global Corporation, Hyvinkää (FI)

(72) Inventors: Teppo Lindberg, Nuppulinna (FI); Henri Kokko, Veikkola (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 362 days.

(21) Appl. No.: 15/113,343

(22) PCT Filed: Jan. 23, 2015

(86) PCT No.: PCT/FI2015/050039
§ 371 (c)(1),
(2) Date: Jul. 21, 2016

(87) PCT Pub. No.: WO2015/110705
PCT Pub. Date: Jul. 30, 2015

(65) Prior Publication Data

US 2017/0029251 A1 Feb. 2, 2017

(30) Foreign Application Priority Data

Jan. 24, 2014 (FI) ..... 20145069

(51) Int. Cl.
*B66C 11/06* (2006.01)
*B66D 1/14* (2006.01)
(Continued)

(52) U.S. Cl.
CPC ..... *B66C 11/06* (2013.01); *B66D 1/12* (2013.01); *B66D 1/14* (2013.01); *B66D 1/36* (2013.01); *B66C 19/00* (2013.01)

(58) Field of Classification Search
CPC ..... B66C 11/00; B66C 11/02; B66C 11/04; B66C 11/06; B66C 19/00; B66D 1/02;
(Continued)

(56) References Cited

U.S. PATENT DOCUMENTS 1,350,648 A * 8/1920 Fitch ..... B66C 7/00 105/113
1,455,369 A 5/1923 Valentine
(Continued)

FOREIGN PATENT DOCUMENTS

EP 0620179 B1 6/1998
GB 1158109 A 7/1969
(Continued)

*Primary Examiner* — Michael R Mansen
*Assistant Examiner* — Juan J Campos, Jr.
(74) *Attorney, Agent, or Firm* — Birch, Stewart, Kolasch & Birch, LLP

(57) ABSTRACT

A low-construction trolley for a wire rope hoist is arranged to travel along a lower flange of a horizontal rail, on both longitudinal edges thereof. The trolley includes a trolley frame; bearing wheels that are attached to the trolley frame and arranged to travel on an upper surface of the lower flange of the rail; a hoisting mechanism including a rope drum for a hoisting rope, a hoisting member in cooperation with the hoisting rope for hoisting a load, a hoisting motor for driving the rope drum, and a gear to interconnect the hoisting motor and the rope drum; whereby the rope drum is supported to one side of the trolley frame and the hoisting member is arranged to travel under the rail in a vertical plane (A) passing substantially through the middle of the beam. For balancing the trolley without using a counterweight, the hoisting motor is placed under the rail and at least partly on a different side than the rope drum in relation to a vertical plane (B) passing through contact lines of the bearing wheels that touch the lower flange of the rail on the rope drum side.

11 Claims, 5 Drawing Sheets

(51) Int. Cl.
*B66C 19/00* (2006.01)
*B66D 1/12* (2006.01)
*B66D 1/36* (2006.01)

(58) Field of Classification Search
CPC ... B66D 1/12; B66D 1/14; B66D 1/28; B66D 1/36
See application file for complete search history.

(56) References Cited

U.S. PATENT DOCUMENTS 2,006,868 A * 7/1935 Neuman ..... B66C 13/00 212/77
3,129,671 A * 4/1964 Vanderbeck ..... B61C 13/04 104/93
4,236,456 A * 12/1980 Schreyer ..... B65G 9/002 104/95
4,343,240 A * 8/1982 Nishimura ..... F16B 21/12 105/54
4,372,452 A * 2/1983 McCord ..... A61G 7/1015 105/153
5,074,423 A * 12/1991 Smith ..... B66C 9/14 212/337
5,461,985 A 10/1995 Gersemsky
5,711,228 A * 1/1998 Itzin ..... B61C 13/04 104/295
5,809,896 A * 9/1998 Gersemsky ..... B66C 7/02 104/107
6,153,992 A * 11/2000 Gersemsky ..... B66C 9/14 318/362
7,234,400 B2 6/2007 Winter et al.
2002/0170872 A1* 11/2002 Kiviniitty ..... B66C 9/14 212/328
2005/0092201 A1 5/2005 Winter et al.
2011/0089129 A1* 4/2011 Gouault ..... B61B 13/04 212/71

FOREIGN PATENT DOCUMENTS

GB 2265348 A 9/1993
WO WO 02/32800 A2 4/2002

* cited by examiner

LOW-CONSTRUCTION TROLLEY FOR WIRE ROPE HOIST

BACKGROUND OF THE INVENTION

The invention relates to a low-construction trolley for a wire rope hoist, arranged to travel along a lower flange of a horizontal beam or rail, whereby the trolley comprises a trolley frame; bearing wheels that are attached to the frame of the trolley and arranged to travel on an upper surface of the lower flange of the beam or rail, on both longitudinal edges thereof, and at least some of which are driven wheels to move the trolley; a hoisting mechanism comprising a rope drum for a hoisting rope, a hoisting member in cooperation with the hoisting rope for hoisting a load, a hoisting motor for driving the rope drum, and a gear to interconnect the hoisting motor and the rope drum, whereby the rope drum is supported to one side of the trolley frame and the hoisting member is arranged to travel under the beam or rail, in a vertical plane passing substantially through the middle of the beam or rail.

A low-construction trolley is a common overhead trolley type for lightweight bridge cranes with one main support. The basic idea behind it is to save hall height by occupying as little space as possible in the vertical direction.

In a-low construction trolley the hoisting device parts are distributed on both sides of one main support so that a lifting hook may be hoisted very close to the main support (yet still under the beam on a neutral axis) in order to make the crane assembly as low as possible. An essential part of this trolley type is its capability to adjust to beams of different widths because the device is used on different kinds of crane main supports. As distinct from this type are a trolley there is trolley of a standard structure, in which the hoisting mechanism parts are fixedly in relation to another as a package under the main support and fastened to adjustable wheel plates forming the trolley, or a monorail type trolley, which is meant to travel on an I profile rail and thus without the possibility to adjust the trolley wheel track. Publication WO 0232800 A2, for example, shows a standard construction trolley. Publications GB 1158109 A and US 145569, in turn, show monorail trolleys.

As a result of the external shape that occupies little space in the vertical direction, the heaviest parts of a low-construction trolley, i.e. the hoisting mechanism and the rope drum, are found on the same side of the main support. Due to this, there is an imbalance between the opposite sides of the main support, and thus a counterweight is typically used in an attempt to compensate for it. The imbalance is harmful because when the trolley is driven without a load, the friction force of the driving bearing wheels may remain too low and cause the wheels to slip. An alternative for a counterweight is to even out the imbalance of the trolley by a contact with the lower surface of the lower flange of the main support, i.e. the horizontal beam or rail mentioned at the beginning. Patents U.S. Pat. No. 7,234,400 B2 and EP 0620179 B1 disclosing low-construction trolleys represent examples of this solution. A feature they have in common is that the support to the lower surface of the lower flange of the rail is achieved by spring-tensioned wheels, particularly on the lower flange side facing away from the hoisting mechanism.

Disadvantages of prior art solutions for balancing the trolley are, in particular, that the trolley becomes heavier and its structure more complicated. Moreover, some of these solutions do not necessarily fully solve the problem of imbalance. Instead, as the structure becomes more complex, other disadvantages appear, for example increase in costs and in the need for maintenance of the trolley. Additional parts also restrict the positioning of the different trolley components, or make it difficult.

SUMMARY OF THE INVENTION

The object of the invention is to solve the problems described above. This object is achieved by a trolley of the invention, characterized in that the hoisting motor is placed under the beam or rail and at least partly on a different side than the rope drum in relation to a vertical plane passing through contact lines of the bearing wheels that touch the lower flange of the beam or rail on the rope drum side. Preferred embodiments of the invention are disclosed in the dependent claims.

The invention is thus based on an idea to use a relatively heavy hoisting motor to replace entirely counterweights and spring supports used before, or to at least reduce the need for compensation for masses.

The hoisting motor is preferably placed under the beam or rail and at least partly on a different side than the rope drum in relation to a vertical plane passing through the beam or rail.

The hoisting motor may be preferably placed so that its longitudinal centre line is parallel to the longitudinal direction of the beam or rail.

The hoisting motor may be placed substantially to the same vertical plane as the beam or rail, the vertical plane passing through the middle of the beam or rail running substantially through the longitudinal centre line of the hoisting motor. It is also possible to move the hoisting motor closer to or further away from the rope drum in relation to said vertical plane as needed until the desired balance is reached, if this is possible in view of the power transmission, rope line and the rest of the trolley structure.

The invention provides a sufficiently uniform bearing contact of the bearing wheels at the flange of the supporting beam or rail, whereby the wear on the bearing wheels is even and the trolley, and thus the hoist, travel without jerking both with and without a load. The structure has a minimum number of components, so the amount of material used and the manufacturing costs are optimal. At the same time, assembly and maintenance are simpler and cost less. Compared with the prior art, a lighter hoist is easier to mount to overhead structures because it is now possible to dispose of the counterweight, for example.

LIST OF FIGURES

The invention is now described in closer detail in connection with preferred embodiments, with reference to the accompanying drawings, in which FIG. 1 is a front view of a first preferred embodiment of a trolley of the invention seen in the direction of a rail supporting it;

DETAILED DESCRIPTION OF THE INVENTION

Figure 1:
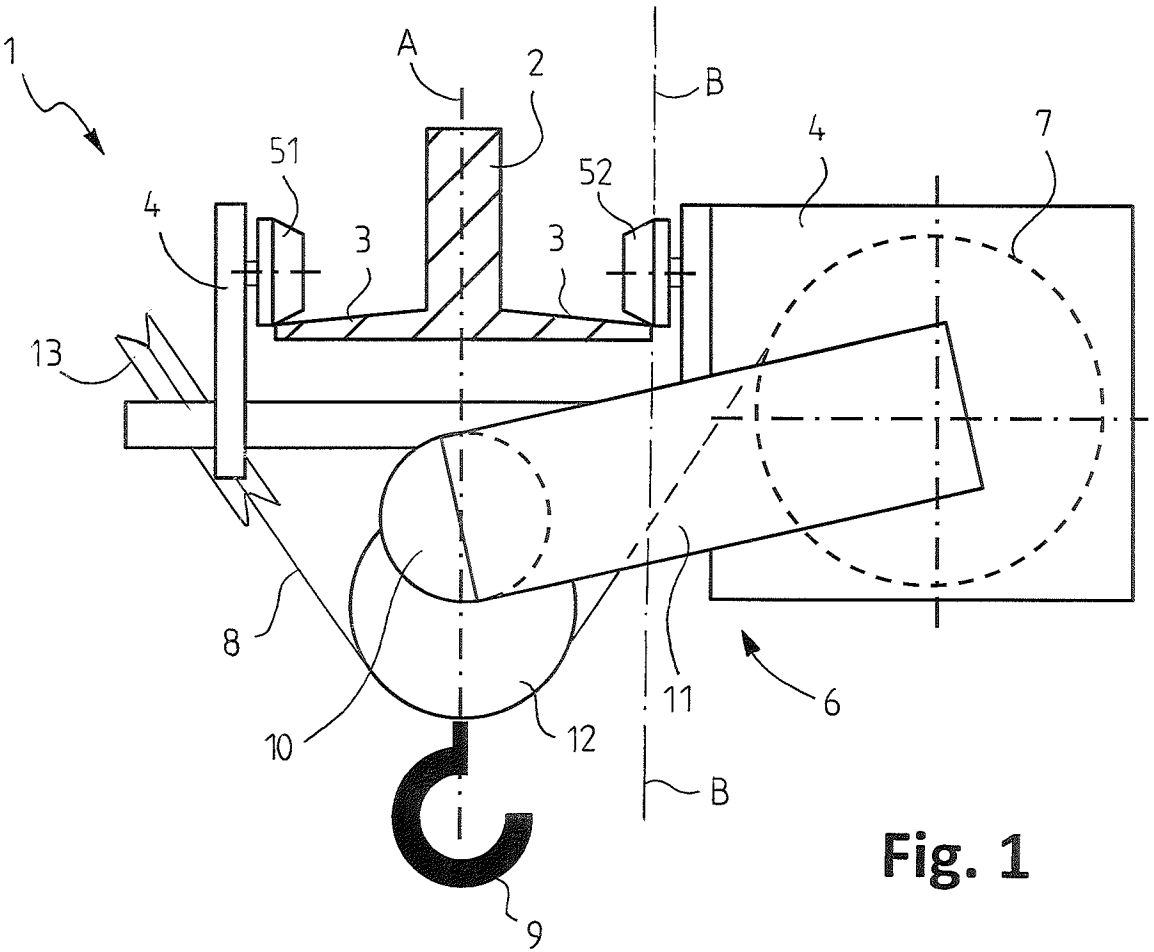
Figure 2:
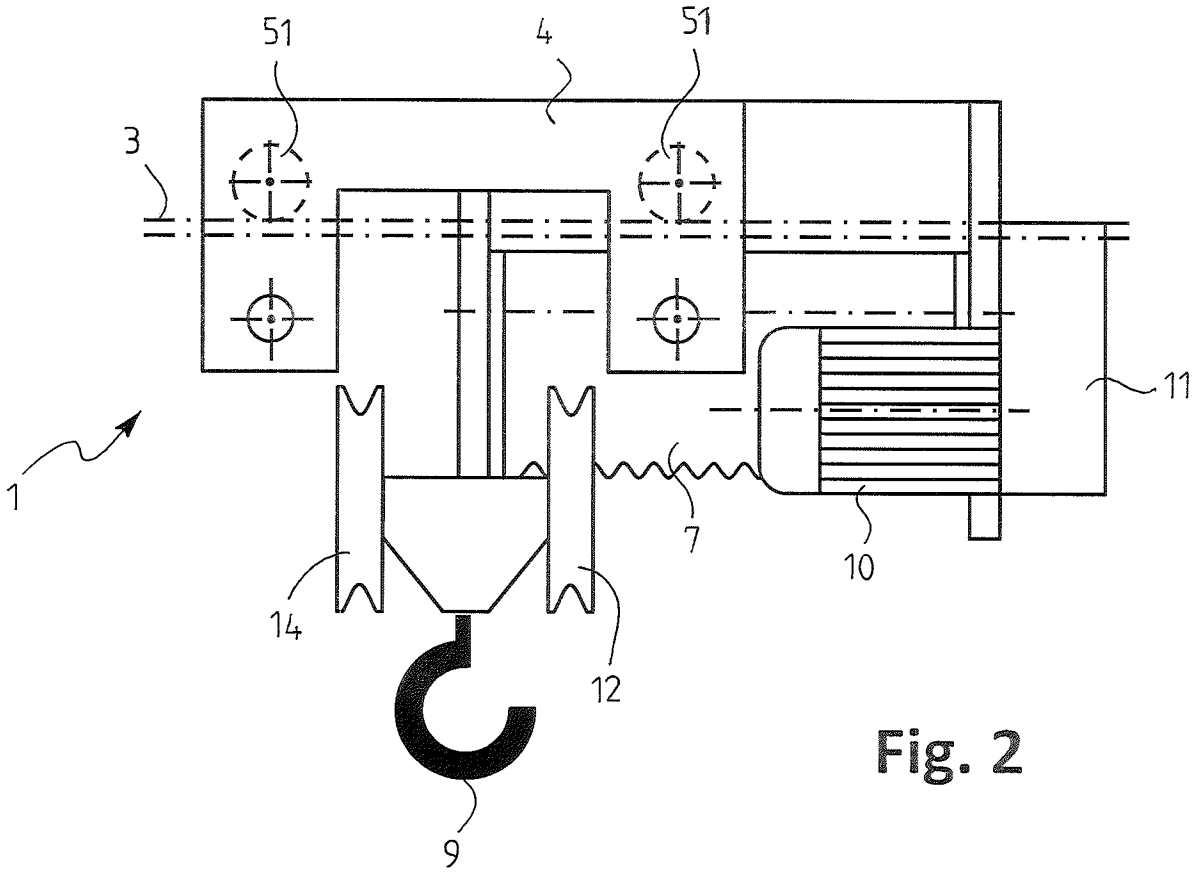
FIG. 2 is a side view of the trolley according to FIG. 1.
Figure 3:
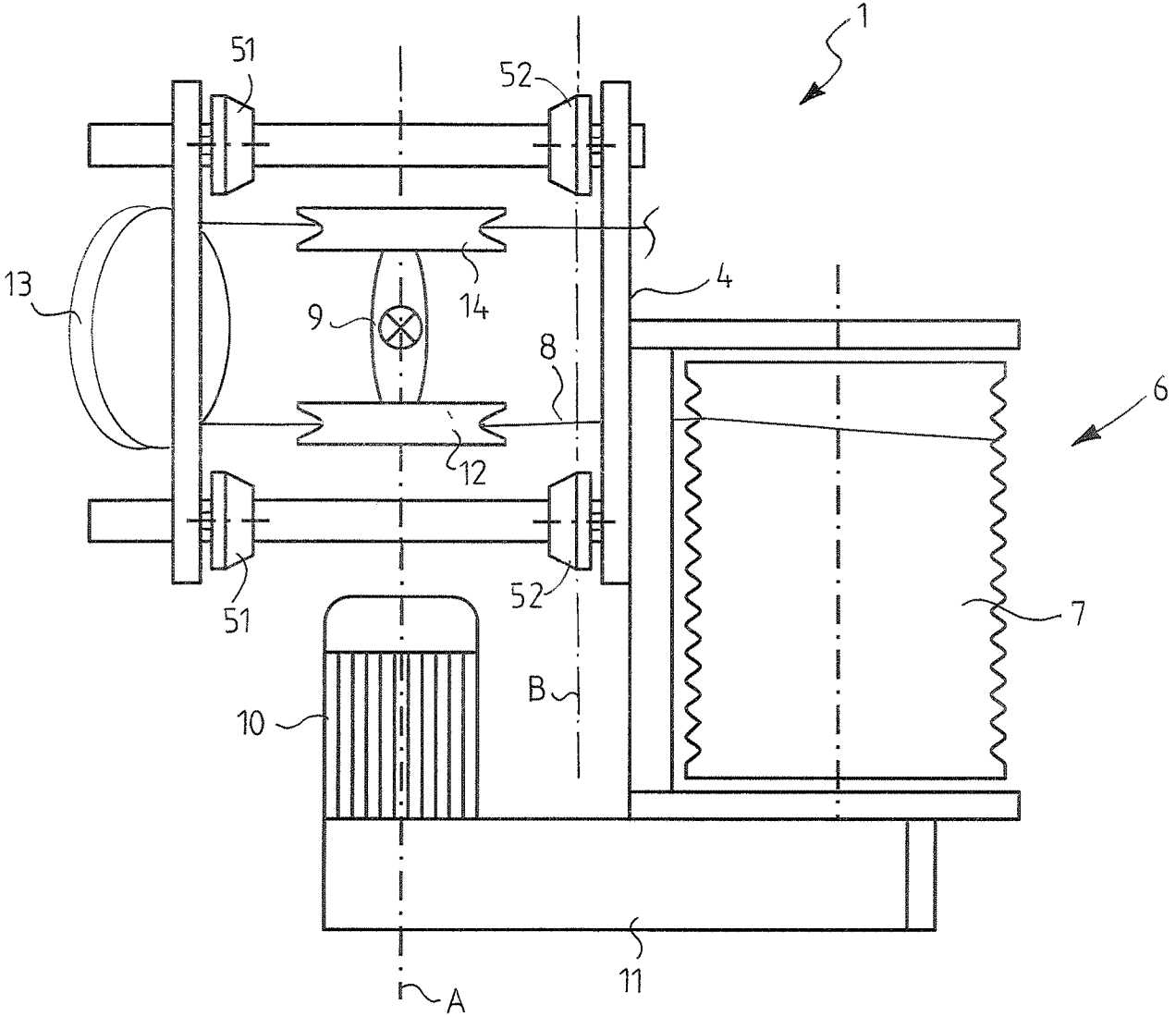
FIG. 3 is a top view of the trolley according to FIG. 1.

With reference to FIGS. 1 to 3, a low construction trolley 1 of a wire rope hoist according to the invention is shown, the trolley being arranged to move along a lower flange 3 of a horizontal beam or, as in here, rail 2. The rail 2 typically forms a main support of a bridge crane, or is included in it as its lower part.

The trolley 1 is shown as a simplified schematic view that only presents what is needed to understand the invention.

The trolley 1 comprises a trolley frame 4, bearing wheels 51 and 52 and a hoisting mechanism 6.

The bearing wheels 51 and 52 are fastened to the frame 4 of the trolley and arranged to travel on the upper surface of the lower flange 3 of the rail 2, on both longitudinal edges thereof, and at least some of them are driven wheels to move the trolley 1. An actuator (a moving mechanism of the trolley) for driving the bearing wheels 51 and 52 is not shown.

The hoisting mechanism 6 comprises a rope drum 7 for a hoisting rope 8, a hoisting member co-operating with the hoisting rope 8, in this case a lifting hook 9, to hoist a load, a hoisting motor 10 to drive the rope drum 7 and a gear 11 to interconnect the hoisting motor 10 and the rope drum 7.

The rope drum 7 is fixed as supported by both of its ends to one side of the trolley frame 4, whereby the centre axis of the rope drum 7 is parallel to the rail 2, and the lifting hook 9 is arranged to travel under the rail 2 in a vertical plane A passing through the middle of the rail.

The hoisting rope 8 is led from the rope drum 7 down to a first rope pulley 12 of the lifting hook 9, from there up to a sheave 13 on the other side of the trolley 1, from the sheave 13 down again to a second rope pulley 14 of the lifting hook 9 and, finally, from there up to a fixing point (not shown) on the frame 4 of the trolley 1 on the same side of the trolley 1 as the rope drum 7. The lifting hook 9 moves up and down depending on whether the hoisting rope 8 is reeled on or off the rope drum 7. This conventional control of the hoisting rope 8 is referred to as a four-rope roping system, in which the hoisting rope 8 is constantly in seven folds. The weight caused by the load is here distributed on four ropes. Another type of roping, e.g. a system of two ropes, is naturally also conceivable. However, the roping system is not essential for the present invention, it is being explained only to illustrate the operation of the hoist.

Then again, in order to balance the trolley 1 or to at least improve the balance, it is essential in the invention that the hoisting motor 10 is placed under the rail 2 and at least partly on a different side than the rope drum 7 in relation to a vertical plane B passing through contact lines of the bearing wheels 52 that touch the lower flange 3 of the rail 2 on the rope drum 7 side on this side of the rail 2, preferably at least partly on a different side than the rope drum 7 in relation to a vertical plane A passing through the middle of the rail 2. Contact lines are longitudinal lines running on the lower flange 3 of the rail 2, the bearing wheels 51, 52 travelling along the lines, which are parallel to the rail 2.

In the embodiment of FIGS. 1 to 3 the hoisting motor 10 is placed with its longitudinal centre line parallel to the longitudinal direction of the rail 2 and, to be more specific, so that the hoisting motor 10 is placed at a substantially same vertical plane as the rail, the vertical plane A passing in the middle of the rail 2 thus running substantially through the longitudinal centre line of the hoisting motor 10. The sideward location of the hoisting engine 10 may, however, be changed as needed to achieve the desired balance.

In this example solution the gear 11 connecting the hoisting motor 10 and the rope drum 7 together are arranged so that the hoisting motor 10 and the rope drum 7 are on the same side in relation to the gear 11, so, as seen from the above, the hoisting motor 10, gear 11 and rope drum 7 are in a C form.

Figure 4:
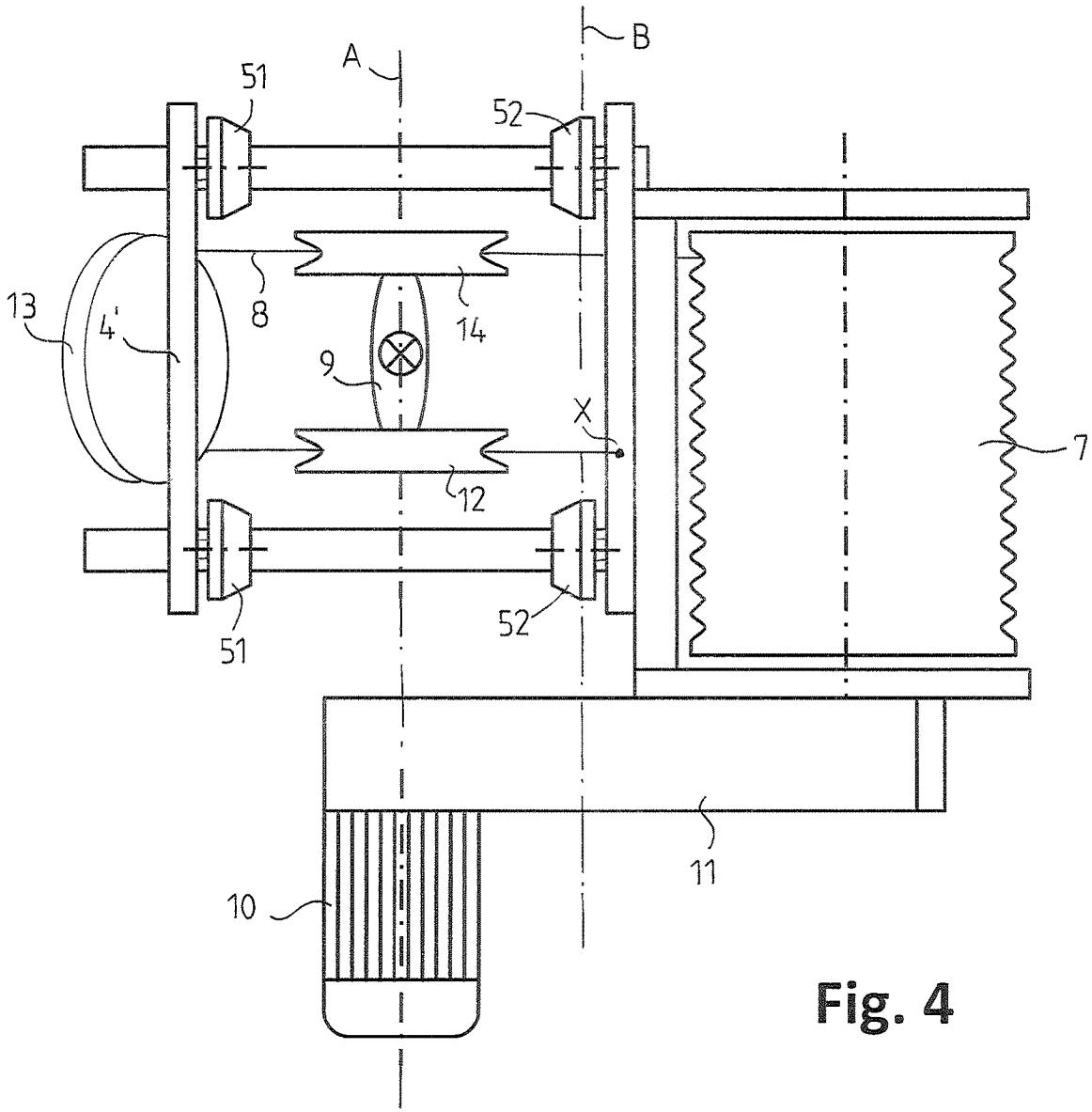
FIG. 4 is a top view of a second preferred embodiment of the trolley according to the invention.

FIG. 4 shows an example embodiment in which the gear 11 interconnecting the hoisting motor 10 and the rope drum 7 are arranged so that the hoisting motor 10 and the rope drum 7 are on different sides in relation to the gear 11, so, as seen from the above, the hoisting motor 10, gear 11 and rope drum 7 are in a Z form. In this implementation the trolley has a frame 4' which differs from the frame 4 of the trolley according to FIGS. 1 to 3 in that the location of the rope drum 7 on the frame 4' has been shifted in the longitudinal direction of the rail 2 so that the rope drum 7 is more in line with the lifting hook 9 and the bearing wheels than in the solution according to FIGS. 1 to 3. This is now possible because no space needs to be reserved between the gear 11 and lifting hook 9 for the hoisting motor 10. Here the control of the hoisting rope 8 differs from the one shown in FIGS. 1 to 3 mainly due to the positioning of the rope drum 7 in the longitudinal direction, the rope being driven from the rope drum 7 down to the rope pulley 14 of the lifting hook 9, from there up to a sheave 13 on the other side of the trolley 1, from the sheave 13 again down to a rope pulley 12 of the lifting hook 9 and, finally, from there up to a fixing point X on the frame 4' of the trolley 1, on the same side of the trolley 1 as the rope drum 7. In a way, here the guiding of hoisting rope 8 to the lifting hook 9 takes place in a reverse order compared to the implementation shown in FIGS. 1 to 3, and the fastening of the hoisting rope 8 to the frame 4' takes place in an area between axes passing through two successive bearing wheels 52.

Figure 5:
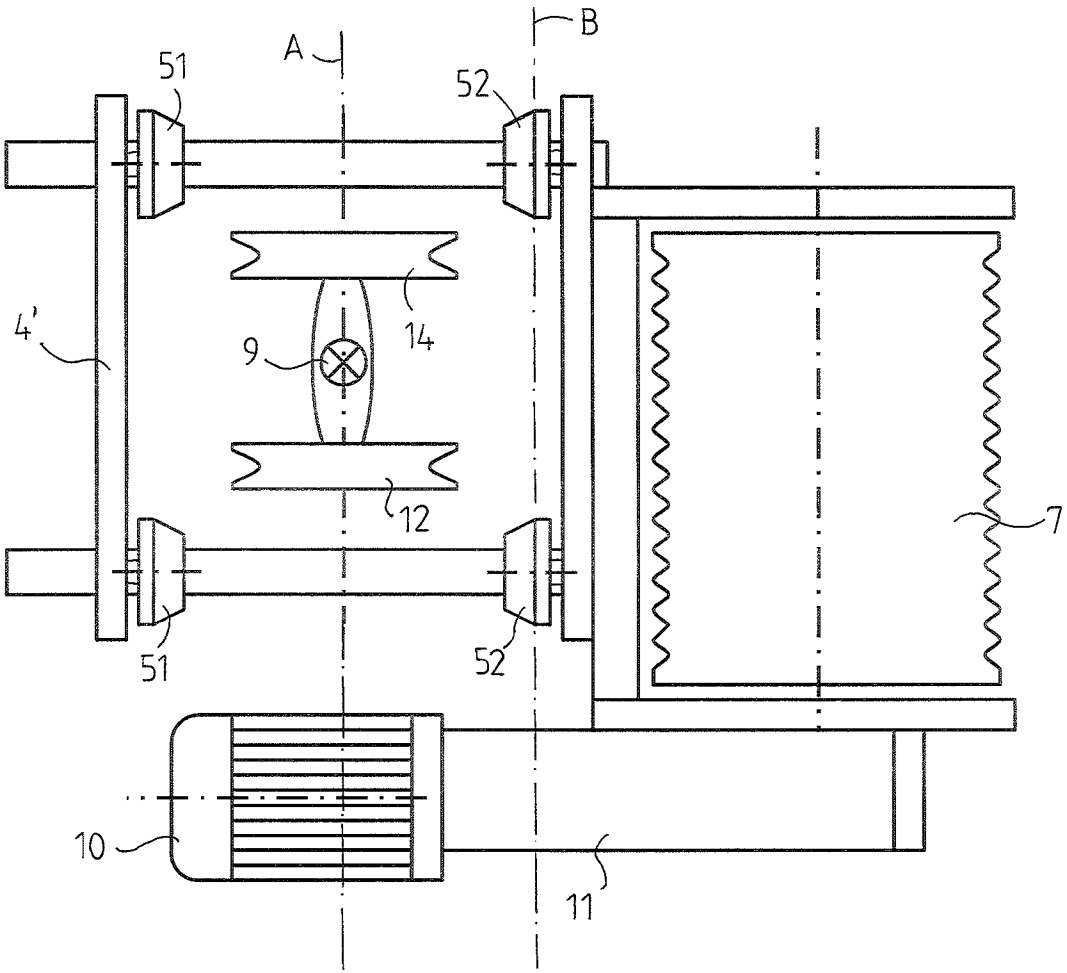
FIG. 5 is a top view of a third preferred embodiment of the trolley according to the invention.

In the embodiment of FIG. 5 the hoisting motor 10 is placed so that its longitudinal centre line is perpendicular to the longitudinal direction of the rail 2. At the same time, the gear 11 has a common transverse line with the hoisting motor 10, the hoisting motor 10, gear 11 and rope drum 11, as seen from the above, thus being in an L form. In this solution, the positioning of the trolley frame 4' and the rope drum 7 is the same as in the implementation according to FIG. 4.

According to an embodiment, it is advantageous to shape and build the structure carrying the trolley 1 so that the beam or rail 2 is connected to a parallel load-bearing casing, which is mostly above the beam or rail 2. In that case the main part of the load may rest on the casing, the beam or rail 2 providing a well-suited fastening bar to the trolley 1.

The above description of the invention is only intended to illustrate the basic idea of the invention. A person skilled in the art may thus vary its details within the scope of the attached claims.

The invention claimed is:

1. A low construction trolley for a wire rope hoist, arranged to travel along a lower flange of a horizontal beam or rail, whereby the trolley comprises:

a trolley frame;

bearing wheels that are attached to the trolley frame and arranged to travel on an upper surface of the lower flange of the beam or rail on both longitudinal edges thereof, and at least some of which are driven wheels to move the trolley; and a hoisting mechanism comprising a rope drum for a hoisting rope, a hoisting member in cooperation with the hoisting rope for hoisting a load, a hoisting motor for driving the rope drum and a gear to interconnect the hoisting motor and the rope drum, whereby the rope drum is supported to one side of the trolley frame and the hoisting member is arranged to travel under the beam or rail in a vertical plane (A) passing substantially through a middle of the beam or rail, wherein the hoisting motor is placed entirely lower than the beam or rail and at least partly on a different side than the rope drum in relation to a vertical plane (B) passing through contact lines of the bearing wheels that touch the lower flange of the beam or rail on the rope drum side, and wherein the hoisting motor is placed so that a longitudinal centre line of the hoisting motor is parallel to the longitudinal direction of the beam or rail.

2. The trolley as claimed in claim 1, wherein the hoisting motor is placed under the beam or rail and at least partly on a different side than the rope drum in relation to the vertical plane (A) passing through the middle of the beam or rail.

3. The trolley as claimed in claim 2, wherein the hoisting motor is placed at essentially a same vertical plane as the beam or rail, whereby the vertical plane (A) passing through the middle of the beam or rail is passing essentially through the longitudinal centre line of the hoisting motor.

4. The trolley as claimed in claim 1, wherein the hoisting motor is placed at essentially a same vertical plane as the beam or rail, whereby the vertical plane (A) passing through the middle of the beam or rail is passing essentially through the longitudinal centre line of the hoisting motor.

5. The trolley as claimed in claim 4, wherein the gear that interconnects the hoisting motor and the rope drum is arranged so that the hoisting motor and the rope drum are on a same side in relation to the gear, whereby the hoisting motor, gear and rope drum are in a C form, as seen from the above.

6. The trolley as claimed in claim 4, wherein the gear interconnecting the hoisting motor and the rope drum is arranged so that the hoisting motor and the rope drum are on different sides in relation to the gear, whereby the hoisting motor, gear and rope drum are in a Z form, as seen from the above.

7. The trolley as claimed in claim 1, wherein the gear that interconnects the hoisting motor and the rope drum is arranged so that the hoisting motor and the rope drum are on a same side in relation to the gear, whereby the hoisting motor, gear and rope drum are in a C form, as seen from the above.

8. The trolley as claimed in claim 1, wherein the gear interconnecting the hoisting motor and the rope drum is arranged so that the hoisting motor and the rope drum are on different sides in relation to the gear, whereby the hoisting motor, gear and rope drum are in a Z form, as seen from the above.

9. The trolley as claimed in claim 1, wherein the hoisting motor is placed so that its longitudinal centre line is perpendicular to the longitudinal direction of the beam or rail.

10. The trolley as claimed in claim 9, wherein the gear is transverse in a same line with the hoisting motor, the hoisting motor, gear and rope drum thus being in an L form as seen from the above.

11. The trolley as claimed in claim 1, wherein the hoisting motor is located between vertical planes passing through the bearing wheels.

* * * * *